US008172169B2

(12) United States Patent
Ishikawa

(10) Patent No.: US 8,172,169 B2
(45) Date of Patent: May 8, 2012

(54) MEDIA-AGITATION TYPE PULVERIZER

(75) Inventor: Tsuyoshi Ishikawa, Narashino (JP)

(73) Assignee: Ashizawa Finetech Ltd., Chiba-Ken (JP)

( * ) Notice: Subject to any disclaimer, the term of this patent is extended or adjusted under 35 U.S.C. 154(b) by 149 days.

(21) Appl. No.: 12/798,828

(22) Filed: Apr. 13, 2010

(65) Prior Publication Data

US 2010/0270408 A1 Oct. 28, 2010

(30) Foreign Application Priority Data

Apr. 22, 2009 (JP) ..... 2009-103529

(51) Int. Cl.
*B02C 17/00* (2006.01)
*B02C 23/02* (2006.01)

(52) U.S. Cl. ..... 241/171; 241/172

(58) Field of Classification Search ..... 241/171, 241/172

See application file for complete search history.

(56) References Cited

U.S. PATENT DOCUMENTS 5,022,592 A * 6/1991 Zakheim et al. ..... 241/172
5,183,214 A * 2/1993 Zakheim et al. ..... 241/30
5,379,952 A * 1/1995 Geiger ..... 241/65
6,029,915 A * 2/2000 Inoue ..... 241/17
7,828,238 B2 * 11/2010 Gunji ..... 241/171

FOREIGN PATENT DOCUMENTS

JP 2005-199125 7/2005

* cited by examiner

*Primary Examiner* — Bena Miller
(74) *Attorney, Agent, or Firm* — Renner, Kenner, Greive, Bobak, Taylor & Weber

(57) ABSTRACT

Disclosed is a media-agitation type pulverizer, which is enabled to acquire products of high quality by excellent pulverizing/dispersing actions. The media-agitation type pulverizer comprises a grinding container having a material entrance and a spherical grinding chamber, an agitating member disposed rotatably in the grinding chamber and near the inner wall of the grinding container, grinding media contained in the grinding chamber, and a centrifugal-type media-separating member rotatably disposed in the grinding chamber and in opposed relation to the agitating member.

12 Claims, 5 Drawing Sheets

A – A

MEDIA-AGITATION TYPE PULVERIZER

The present invention relates to a media-agitation type pulverizer. The media-agitation type pulverizer is particularly suitably used, although not imitative, to mix a target material, such as ink, paint, pigment, ceramics, metal, inorganics, dielectrics, ferrite, toner, glass or paper coating color, with grinding media, to pulverize or disperse the material into fine particles.

DESCRIPTION OF THE BACKGROUND ART

A media-agitation mill, as proposed in JP 2005-199125 A, is known as the media-agitation type pulverizer.

The media-agitation mill proposed in JP 2005-199125A comprises a grinding container having a grinding chamber for receiving grinding media therein, a rotary shaft rotatably disposed in the grinding container, and an agitating/separating member disposed at the rotary shaft in a position located in the grinding container and adapted to rotate integrally with the rotary shaft, wherein the inner wall surface of the grinding chamber and the outer circumference of the agitating/separating member are formed in a shape to conform to each other. The media-agitation mill further comprises a separation/discharge passage extending from the outer circumference to the central portion of the agitating/separating member and then extending from the central portion through the central portion of the rotary shaft so as to communicate with the outside of the grinding chamber, and pressure reduction hole extending between the upper and lower surfaces of the agitating/separating member in the axial direction of the rotary shaft so as to provide communication between the upper and lower portions of the inside of the grinding member.

[Patent Document 1] JP 2005-199125 A

In the above media-agitation mill of the aforementioned structure, however, the grinding media are apt to be locally concentrated in a maximum-diameter portion where a centrifugal force is maximized, and a dispersion or pulverization force will vary depending on the position with a large difference. Thus, there is a problem that the dispersion or pulverization of a target material is not uniformly performed to make it difficult to obtain a high-quality product.

It is, therefore, an object of the present invention to provide a media-agitation type pulverizer, which is enabled to acquire products of high quality by excellent pulverizing/dispersing actions.

The aforementioned object is achieved by a media-agitation type pulverizer of the present invention having the features (1) to (13), as set forth in the following.

(1) A media-agitation type pulverizer comprising: a grinding container having an upright-type cylindrical grinding chamber containing bead-shaped grinding media; a material slurry supply port formed in the grinding container; an agitating member disposed in the lower portion of said grinding chamber and having a shaft of rotation made substantially coaxial with said grinding chamber; and a media-separating member disposed in said grinding chamber and above said agitating member, wherein the improvement comprises a guide ring for dividing the lower portion of said grinding chamber radially into an inner portion and an annular outer portion thereby to form said lower-outer portion of said grinding chamber as a rising passage of a mixture of the grinding media and the material slurry.

(2) A media-agitation type pulverizer as set forth (1), wherein said guide ring has an annular space and is supported by a plurality of pipes mounted on said grinding container so that water can be supplied to and discharged from said annular space via said pipes.

(3) A media-agitation type pulverizer as set forth in (2), wherein said pipes extend from above said grinding container and support said guide ring at the lower ends thereof.

(4) A media-agitation type pulverizer as set forth in (1), wherein said media-separating member is a centrifugal-type wheel-shaped separating member or screen.

(5) A media-agitation type pulverizer as set forth in (1), wherein said agitating member is an impeller including a pair of annular plates spaced vertically from each other, and a plurality of blades arranged therebetween.

(6) A media-agitation type pulverizer as set forth in (1), wherein said agitating member rotates at a circumferential speed of 5-40 m/s.

(7) A media-agitation type pulverizer as set forth in (1), wherein said guide ring has a lower end positioned at or higher than the upper end of said agitating member and an upper end positioned downward at a predetermined spacing from the lower end of said media-separating member.

(8) A media-agitation type pulverizer as set forth in (1), wherein the spacing between the outer circumference wall of said guide ring and the inner circumference wall of said grinding container is 10 to 50 mm.

(9) A media-agitation type pulverizer as set forth in (1), wherein the height of said guide ring is ⅓ to ½ of the height of said grinding chamber.

(10) A media-agitation type pulverizer as set forth in (1), wherein the total volume of said grinding media shares 30% to 60% of the volume of said grinding chamber.

(11) A media-agitation type pulverizer as set forth in (1), further comprising: a first drive shaft extending in the direction opposed to said media-separating member from said agitating member to the outside of said grinding container; a second drive shaft extending in the direction opposed to said agitating member from said media-separating member to the outside of said grinding container; and a flow conversion member arranged near the inner circumference wall of said grinding container, for converting that flow of said material and said grinding media, which is directed outward of the circumferential direction by the rotation of said agitating member, into a radially inward direction, wherein said agitating member and said media-separating member are arranged at such an axial spacing that the interference therebetween may be smaller, and wherein said second drive shaft is made of a hollow shaft, the inside of which communicates with the inside of said media-separating member thereby to form a material outlet passage.

(12) A media-agitation type pulverizer as set forth in (11), wherein the ratio S/d is 0.3 or more, if the spacing between said agitating member and said media-separating member is designated by S and if the diameter of said agitating member is designated by d.

(13) A media-agitation type pulverizer as set forth in (11), wherein the total volume of said grinding media is 60% or less than the volume of said grinding container.

The media-agitation type pulverizer of the invention is provided with the guide ring in the grinding chamber, as described above, so that the grinding media can repeat regularly those operations, in which the grinding media move radially outward of the grinding chamber and toward the inner wall of the grinding container, while moving in the circumferential direction, then rise in the rising passage between the guide ring and the grinding container, then move downward from the central portion through the inside of the guide ring, and return to the agitating member. Even if the capacity ratio of the beads to the grinding chamber is small, the bead interval does not spread wide so that the pulverizing/dispersing efficiency can be improved. Thus, the segregation of the grinding media is less likely to occur, and a dispersion or pulverization force is kept uniform. This also makes it possible to achieve uniform dispersion thereby to obtain a high-quality product.

Moreover, the functional dispersion of the grinding portion and the media-separating portion is clarified to improve the media-separating performance.

In addition to the cooling of the outer cylinder of the grinding chamber, moreover, the cooling at the guide ring can be performed to improve the cooling capacity.

With reference to the accompanying drawings, the present invention will now be described in connection with a media-agitation type pulverizer according to an embodiment thereof.

Figure 1:
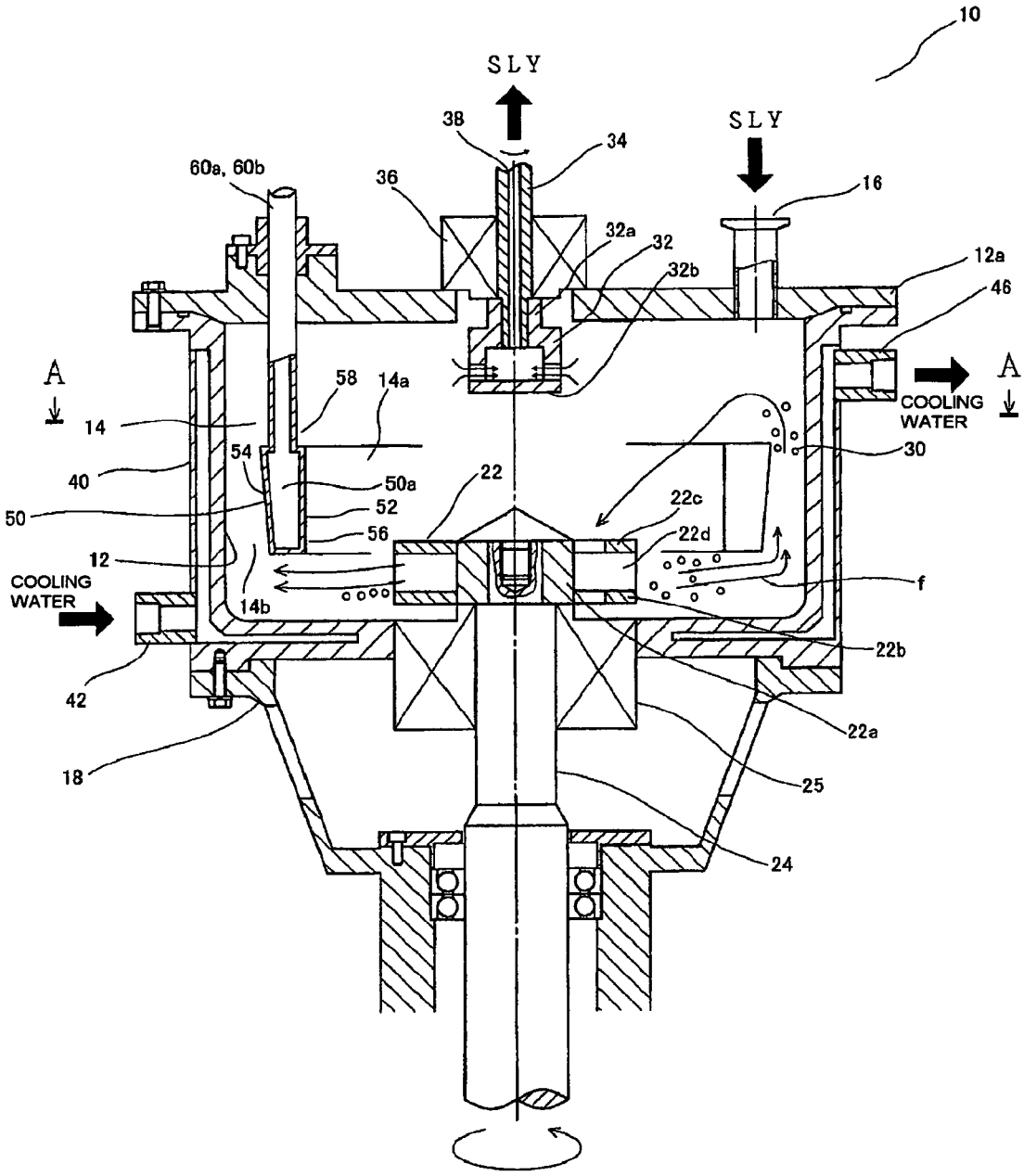
FIG. 1 is a sectional view showing a media-agitation type pulverizer according to a first embodiment of the invention.

FIG. 1 shows a media-agitation type pulverizer 10 according to a first embodiment of the invention. The media-agitation type pulverizer 10 comprises an upright-type cylindrical grinding container 12 having an end plate 12*a* closing the upper portion of the pulverizer 10. The grinding container 12 has a cylindrical grinding chamber 14, which is equipped therein with a material slurry supply port 16 for introducing a target material in a slurry state, into the grinding chamber 14.

At the center of the lower portion of the inside of the grinding chamber 14 of the grinding container 12, there is rotatably arranged an agitating member 22, which is fixed as an impeller around a boss 22*a*, for example. The agitating member 22 is constituted of a pair of annular plates 22*b* and 22*c* arranged at a vertical spacing, and a plurality of blades 22*d* arranged between those plates.

To the agitating member 22, there is fixed a rotational drive shaft 24 acting as an agitating-member driving shaft, which is fixed at an upper end thereof to the boss 22*a* of the agitating member 22 and extends axially downward through the grinding container 12 and a frame 18. Although now shown, the rotational drive shaft 24 has a lower end connected to a driving source via a not-shown conventional drive mechanism, so that it is rotationally driven in a direction indicated by an arrow in FIG. 1. Preferably, the rotational drive shaft 24 is arranged to allow its rotation axis to pass through the center of the grinding chamber 14. Here, the rotational drive shaft 24 is equipped with a shaft sealing device 25 (e.g., a mechanical seal).

As well known in the media-agitation type pulverizer, bead-shaped grinding media 30 are contained in the grinding container 12 (although the grinding media 30 are extremely enlarged in FIG. 1). The grinding media 30 to be used may have a diameter of 0.02 to 2 mm. The total volume of the grinding media 30 shares 30% to 60% of the volume of the grinding chamber 14. In the ordinary media-agitation type pulverizer, the total volume of the grinding media is 75% to 90% of the volume of the grinding chamber. Thus, the media-agitation type pulverizer of the invention can perform soft pulverization and dispersion with a little constriction.

A centrifugal-type media-separating member 32 is rotatably disposed in an upper portion of the inside of the grinding chamber 14 of the grinding container 12 and axially spaced apart and opposed to the aforementioned agitating member, thereby to separate the grinding media 30 dispersed in the material slurry, from said target material. The media-separating member 32 is equipped with a boss 32*a* made of a cylindrical body having an internal space in a lower portion thereof, and a closing plate 32*b* for closing the lower portion of that body. The body of the boss 32*a* has a plurality of openings, through which the material slurry is exclusively introduced into the aforementioned space of the body. Although it is preferred that the media-separating member 32 is arranged in concentric relation to the aforementioned grinding member 22, these members may have axes out of alignment. It is also preferred that the aforementioned agitating member 22 is so sufficiently spaced from the media-separating member 32 as to reduce the interference of the media-separating member 32 extremely. A hollow rotational drive shaft 34 is fixed to that media-separating member 32. The rotational drive shaft 34 extends upward through the end plate 12*a* and has its end portion connected to the driving source through the not-shown known drive mechanism, so that it is rotationally driven in the direction, as indicated by arrow in FIG. 1. The rotational drive shaft 34 is equipped with a shaft sealing device 36 (e.g., a mechanical seal). Moreover, the hollow space of the drive shaft 34 communicates with the inside of the media-separating member 32 thereby to form a material slurry outlet 38. The aforementioned media-separating member can be exemplified by a conventional screen.

Around the outer circumference of the grinding container 12, there is mounted a jacket 40 for allowing a cooling medium or a heating medium (usually, a cooling medium such as a coolant) to flow therethrough, thereby to adjust the internal temperature of the grinding chamber 14. The jacket 40 is equipped at its lower portion with a coolant inlet 42 for introducing the coolant therethrough and at its upper portion with a coolant outlet 46 for discharging the coolant therefrom.

The grinding container 12 can be opened to facilitate maintenance by removing the aforementioned end plate 12*a*.

In the media-agitation type pulverizer of the invention, the aforementioned agitating member 22 can be driven at a rotating speed within a range of the circumferential speed of 5 to 40 m/s, and the media-separating member 32 can be driven at a rotating speed within a range of 10 to 20 m/s.

At a lower portion in the aforementioned grinding chamber 14, there is arranged a guide ring 50. This guide ring 50 is constituted to include an inner-circumference annular plate 52, an outer-circumference annular plate 54 spaced circumferentially from the former, a lower annular plate 56 forming the lower side and an upper annular plate 58 forming the upper side, and is made liquid-tight in the inside thereof.

The guide ring 50 divides the lower portion of the aforementioned grinding chamber 14 radially to form a lower-inner chamber portion 14*a* and a lower-outer annular chamber portion 14*b*. This lower-outer annular chamber portion 14*b* performs a function to provide a rising passage for the mixture of the grinding media and the material slurry.

Figure 2:
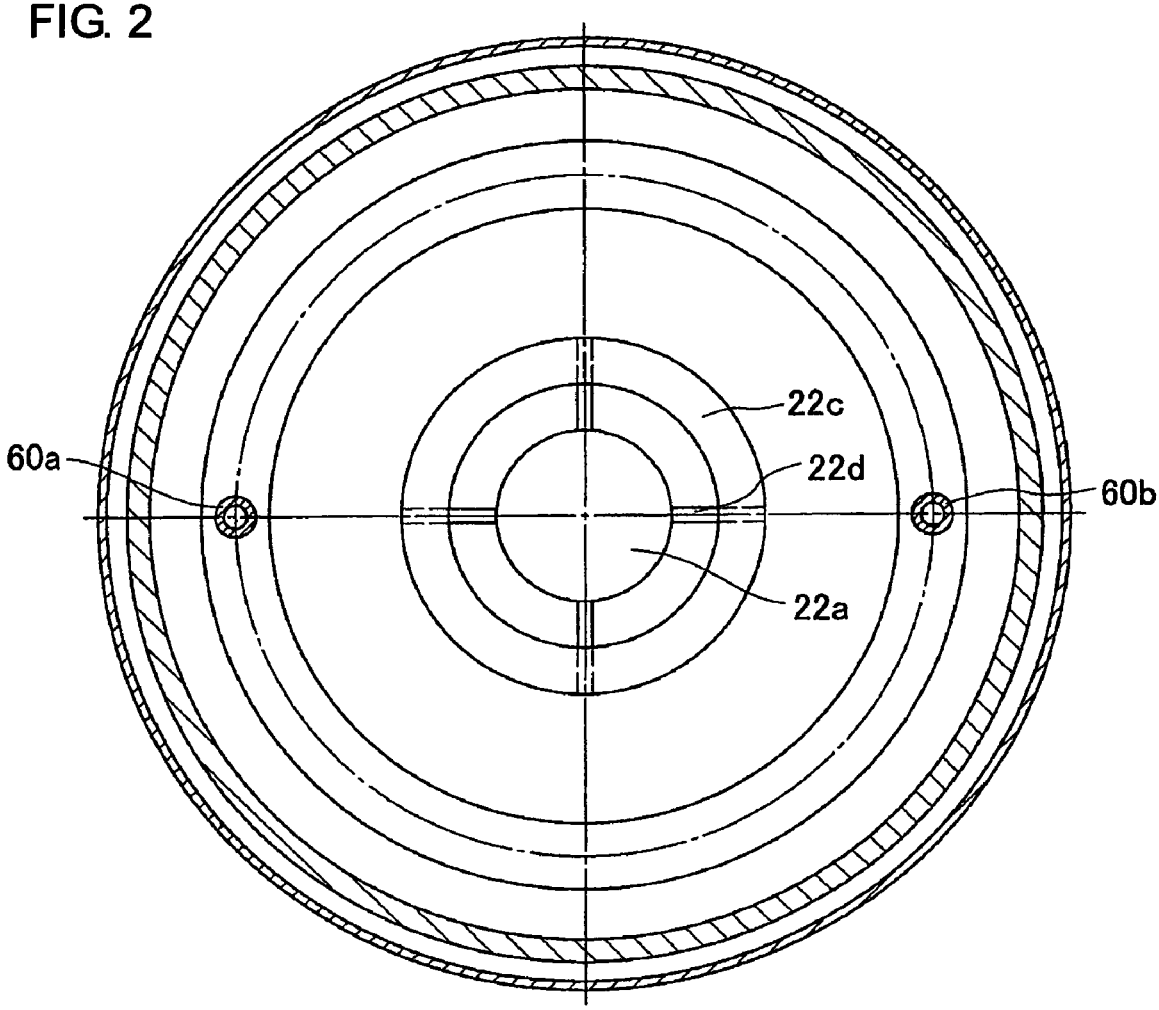
FIG. 2 is a sectional view taken along line A-A of FIG. 1.

The guide ring 50 has the structure described above, and forms an annular space 50*a*. The guide ring 50 is supported by a plurality of pipes 60*a* and 60*b* (as referred to FIG. 2) mounted in the aforementioned grinding container, so that the coolant can be supplied to and discharged from the annular space by way of those pipes 60*a* and 60*b*. According to the invention, therefore, the material slurry can also be cooled from the inside of the grinding container 12.

It is preferred that the pipes 60*a* and 60*b* extend from above the grinding container 12, as shown, thereby to support the aforementioned guide ring 50 at their lower ends.

It is preferred that the aforementioned guide ring 50 has its lower end positioned at or higher than the upper end of the aforementioned agitating member 22 and its upper end positioned at a predetermined downward spacing from the lower end of the aforementioned media-separating member 32.

It is preferred that the spacing between the outer circumference wall of the guide ring 50 and the inner circumference wall of the grinding container 12 is 10 to 50 mm. That spacing constricts the bead movements excessively, if it is less than the aforementioned lower limit, and allows the degree of freedom excessively, if more than the aforementioned upper limit.

It is preferred that the height of the aforementioned guide ring 50 is ⅓ to ½ of the height of the grinding chamber 14. The height makes the control of the bead flow insufficient, if it is less than the aforementioned lower limit, and deteriorates the smoothness of the bead flow if more than the upper limit.

In the operations, the agitating member 22 is rotationally driven while introducing the material slurry containing the particles to be pulverized, from the material slurry supply port 16 into the grinding chamber 14. The slurry thus introduced into the grinding chamber 14 is moved as a falling flow toward the agitating member 22 while being carried on the rotating flow of the slurry and the media 30, which has already been formed in the grinding chamber 14, so that they are agitated and mixed by the agitating member 22. At this time, the slurry and the media 30 are moved radially outward to the inner wall of the grinding container 12. After this, the slurry and the media 30 thus agitated and mixed rise as a flow f in the rising passage between the inner wall of the grinding chamber 14 and the guide ring 50. The flow goes up to the uppermost position and then becomes the aforementioned falling flow. In the portion adjacent to and slightly above the central portion of the grinding chamber 14, rotational movements are applied to the slurry and the media by the media-separating member 32. By the rotational movements, the grinding media having relatively large masses are forced to move radially outward and are separated from the slurry. In this case, parts of the pulverized particles having relatively large particle sizes due to insufficient pulverization behave like the media. On the other hand, the slurry containing the remaining particles sufficiently pulverized and reduced in mass is introduced into the inner space of the media-separating member 32 and discharged to the outside of the media-agitation type pulverizer via the material outlet 38 in the rotational drive shaft 34. Thanks to this construction, in the aforementioned regular flows, the material particles are sufficiently pulverized and dispersed through contact with the freely-moving grinding media, so that a high-quality product is obtained. By the operations thus far described, the media-agitation type pulverizer of the invention can achieve the pulverization of a relatively small width of particle size distribution. Moreover, the quantity of the grinding media can be spared.

Figure 3:
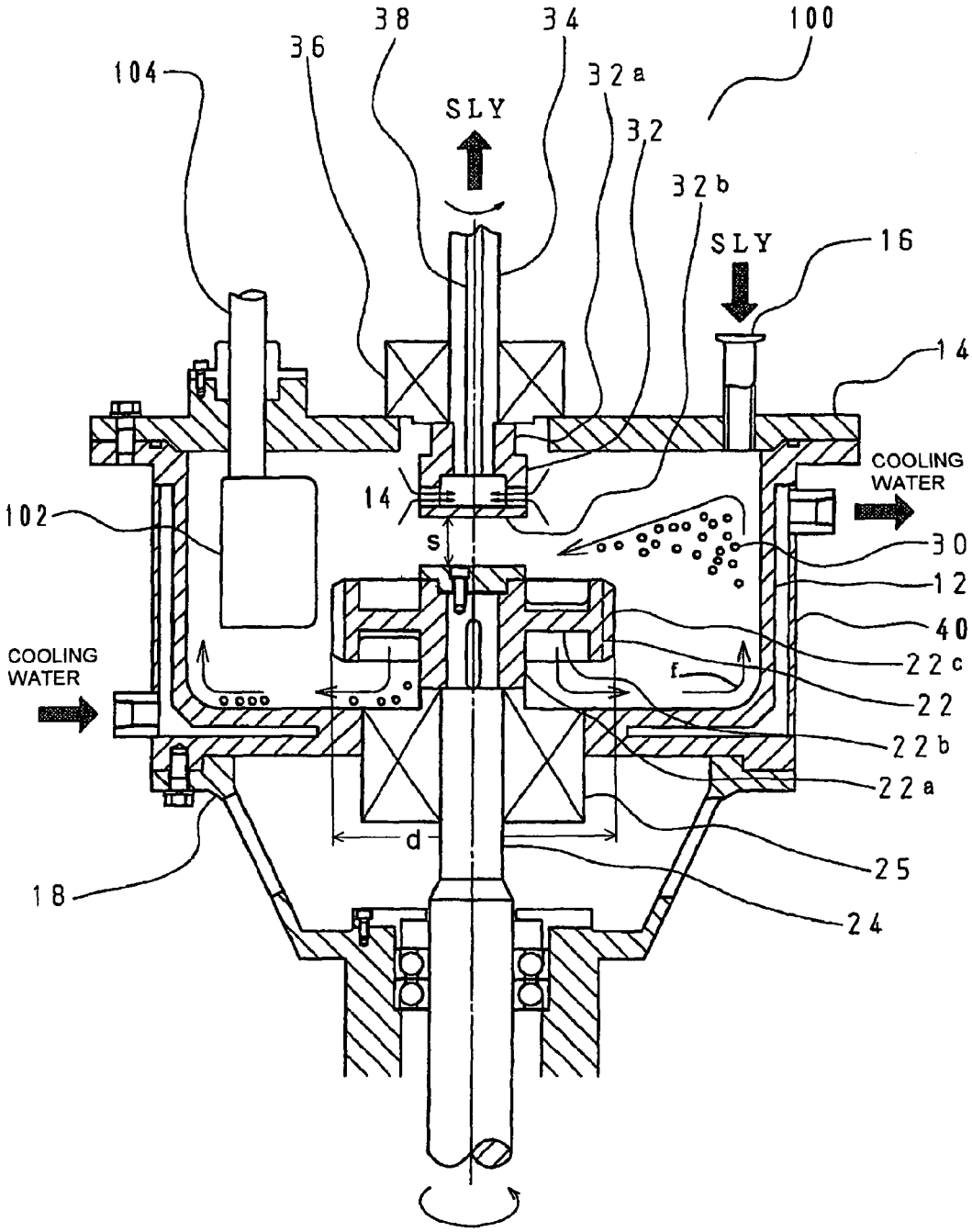
FIG. 3 is a sectional view showing a media-agitation type pulverizer according to a second embodiment of the invention.

FIG. 3 shows a media-agitation type.pulverizer 100 according to a second embodiment of the invention. The description of this media-agitation type pulverizer is omitted by designating the same parts and the same portions by the common reference numerals, since the structure is substantially common, excepting a flow conversion member 102 to be described later. Here, the media-agitation type pulverizer 100 of this embodiment is also equipped with the guide ring 50, although the guide ring 50 is omitted from FIG. 3.

Figure 4:
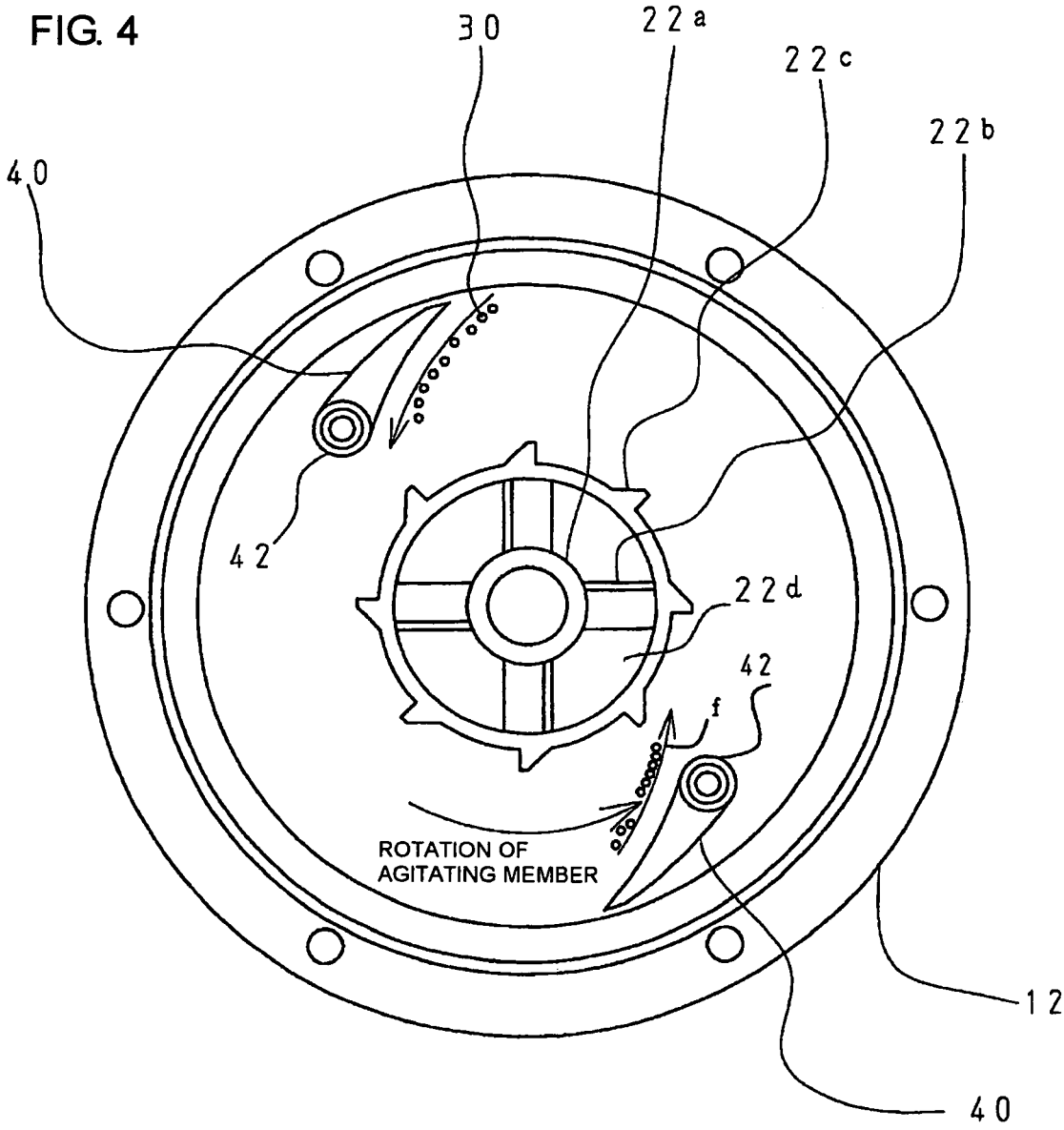
FIG. 4 is a view for explaining an arrangement state of an agitating member and a flow conversion member.

The flow conversion member 102 (although only one is shown in FIG. 3) is arranged in the upper portion near the inner circumference wall of the grinding chamber 14 of the aforementioned grinding container 12. The flow conversion member 102 is formed into the shape of a straightening plate acting to convert that flow of the material slurry and the grinding media 30, which has been directed outward of the circumferential direction by the rotation of the agitating member, into the radially inward direction. When the agitating member 22 has a high rotating speed, that flow conversion member 102 acts to prevent the grinding media 30 from being otherwise centrifugally brought into contact with the inner circumference wall of the grinding container 12. At least one, usually one or two, flow conversion member 102 is desirably arranged in the grinding chamber 14. It is preferred that the flow conversion member 102 has its lower end positioned substantially at or higher than the upper end of the agitating member 22 and its upper end extended to the vicinity of the end plate 12*a*. It is also preferred that the flow conversion member 102 has a horizontal sectional shape made the thinner as it comes the closer to the inner circumference wall of the grinding container 12, as shown in FIG. 4 (from which the guide ring 50 is also omitted).

The flow conversion member 102 is preferably equipped at its root portion with a rod-shaped member 104, which has an upper end protruding to the outside of the grinding container 12 so that the angle or height position of the flow conversion member 102 can be adjusted from the outside of the grinding container 12.

Figure 5:
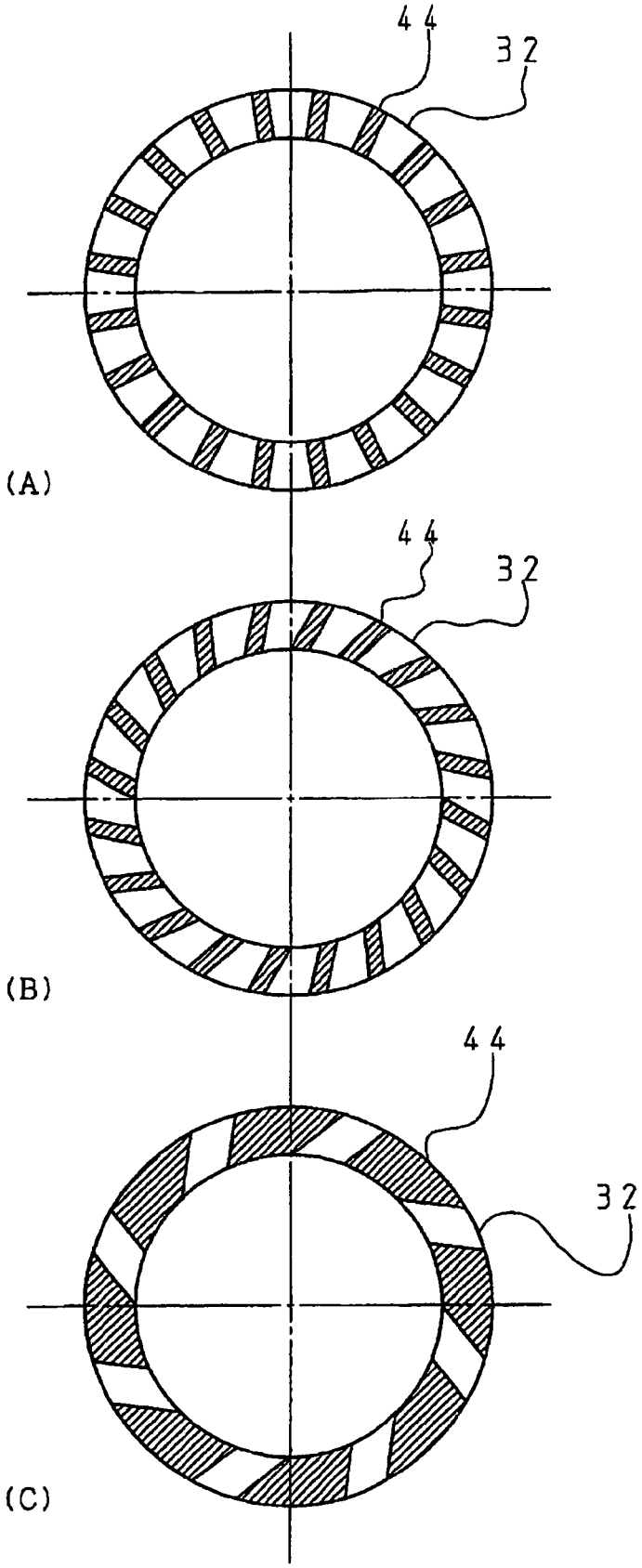
FIGS. 5(A), 5(B) and 5(C) are sectional views showing individual examples of blade members of a media-separating member used in the media-agitation type pulverizer shown in FIG. 3 and FIG. 1.

On the other hand, the aforementioned media-separating member 32 is equipped with a plurality of blade members 44 (as referred to FIG. 5(A)), which are arranged equidistantly in the circumferential direction (coaxially with the rotational drive shaft 34) between the boss 32*a* and the closing plate 32*b*. The blade members 44 may be arranged either completely radially, as shown in FIG. 5(A), or obliquely, as shown in FIG. 5(B). Alternatively, the blade members 44 may be made so quadrangular that their sections become gradually thinner toward the inside, as shown in FIG. 5(C).

It is preferred that the ratio S/d is 0.3 or more, especially 0.3 to 0.6, if the spacing between the agitating member 22 and the media-separating member 32 is designated by S and if the diameter of the agitating member 22 is designated by d. If the aforementioned ratio S/d is less than 0.3, the extent of the interference between the agitating member and the media-separating member is undesirable.

It is preferred that the total volume of the grinding media 30 is 60% or less, especially 30 to 50% of the volume of the aforementioned grinding container 12 (or the grinding chamber 14). If the total volume of the grinding media 30 exceeds 60% of the volume of the grinding container 12 (or the grinding chamber 14), the degree of freedom of the grinding media 30 is lost to make the control of the grinding media 30 difficult. Moreover, it is desired that the pouring horizontal height of the grinding media 30 is lower than the height of the media-separating member 32. If the pouring horizontal height of the grinding media exceeds the height of the media-separating member, the separability of the grinding media by the media-separating member drops.

In the media-agitation type pulverizer according to the embodiment of the invention, the agitating member 22 can be driven at a rotating speed within a range of 5 to 40 m/s, and the media-separating member 32 can be driven at a rotating speed within a range of 10 to 20 m/s.

In the operations, the agitating member 22 is rotationally driven while introducing the material or the slurry containing the particles to be pulverized, from the material slurry supply port 16. The slurry thus introduced into the grinding chamber 14 is moved toward the agitating member 22 while being carried on the rotating flow f of the slurry and the media 30, which has already been formed in the grinding chamber 14, so that they are agitated. The flow, which rotates radially outward while rising in the passage between the agitating member 22 and the guide ring 50, is converted into a radially inward one by the action of the flow conversion member 102, thereby to form the rotating flow f of the slurry and the media 30. By this rotating flow f of the grinding media, the particles to be pulverized in the slurry are pulverized or dispersed in the grinding chamber 14. In the portion above the grinding chamber 14, the rotational movements are applied to the slurry and the media by the media-separating member 32. By these rotational movements, the grinding media having the relatively large masses are forced to move radially outward and are separated from the slurry. In this case, parts of the pulverized particles having relatively large particle sizes due to insufficient pulverization behave like the media. On the other hand, the slurry containing the remaining particles sufficiently pulverized and reduced in mass is introduced into the inner space of the media-separating member 32 and discharged to the outside of the media-agitation mill via the material outlet 38 in the rotational drive shaft 34. This constitution makes it possible to achieve the pulverization of a small width of particle size distribution.

The invention claimed is:

1. A media-agitation type pulverizer comprising: a grinding container having an upright type cylindrical grinding chamber containing bead-shaped grinding media; a material slurry supply port formed in the grinding container; an agitating member disposed in the lower portion of said grinding chamber and having a shaft of rotation made substantially coaxial with said grinding chamber; and a media-separating member disposed in said grinding chamber and above said agitating member, which comprises: a guide ring arranged in said grinding chamber so as to divide a portion of said grinding chamber radially into an inner portion and an annular outer portion; and a rising passage which is formed by said annular outer portion of said grinding chamber between said guide ring and an inner wall of said grinding chamber and in which a mixture of the grinding media and the material slurry is agitated and mixed by said agitating member, wherein said guide ring has its lower end positioned at or higher than the upper end of the agitating member and its upper end positioned at a predetermined downward spacing from the lower end of the media-separating member.

2. A media-agitation type pulverizer as defined in claim 1, wherein said media-separating member is a centrifugal-type wheel-shaped separating member or screen.

3. A media-agitation type pulverizer as defined in claim 1, wherein said agitating member is an impeller including a pair of annular plates spaced vertically from each other, and a plurality of blades arranged therebetween.

4. A media-agitation type pulverizer as defined in claim 1, wherein said agitating member rotates at a circumferential speed of 5-40 m/s.

5. A media-agitation type pulverizer as defined in claim 1, wherein the spacing between the outer circumference wall of said guide ring and the inner circumference wall of said grinding container is 10 to 50 mm.

6. A media-agitation type pulverizer as defined in claim 1, wherein the height of said guide ring is ⅓ to ½ of the height of said grinding chamber.

7. A media-agitation type pulverizer as defined in claim 1, wherein the total volume of said grinding media shares 30 % to 60 % of the volume of said grinding chamber.

8. A media-agitation type pulverizer comprising:

a grinding container having an upright type cylindrical grinding chamber containing bead-shaped grinding media; a material slurry supply port formed in the grinding container; an agitating member disposed in the lower portion of said grinding chamber and having a shaft of rotation made substantially coaxial with said grinding chamber; a media-separating member disposed in said grinding chamber and above said agitating member, and a guide ring for dividing the lower portion of said grinding chamber radially into an inner portion and an annular outer portion thereby to form said lower-outer portion of said grinding chamber as a rising passage of a mixture of the grinding media and the material slurry, wherein said guide ring has an annular space and is supported by a plurality of pipes mounted on said grinding container so that water can be supplied to and discharged from said annular space via said pipes.

9. A media-agitation type pulverizer as defined in claim 8, wherein said pipes extend from above said grinding container and support said guide ring at the lower ends thereof.

10. A media-agitation type pulverizer, comprising:

a grinding container having an upright type cylindrical grinding chamber containing bead-shaped grinding media; a material slurry supply port formed in the grinding container; an agitating member disposed in the lower portion of said grinding chamber and having a shaft of rotation made substantially coaxial with said grinding chamber; a media-separating member disposed in said grinding chamber and above said agitating member, a first drive shaft extending in the direction opposed to said media-separating member from said agitating member to the outside of said grinding container; a second drive shaft extending in the direction opposed to said agitating member from said media-separating member to the outside of said grinding container; and a flow conversion member arranged near an inner circumference wall of said grinding container, for converting that flow of said material and said grinding media, which is directed outward of the circumferential direction by the rotation of said agitating member, into a radially inward direction, wherein said agitating member and said media-separating member are arranged at such an axial spacing that the interference therebetween may be smaller, and wherein said second drive shaft is made of a hollow shaft, the inside of which communicates with an inside of said media-separating member thereby to form a material outlet passage, and a guide ring for dividing the lower portion of said grinding chamber radially into an inner portion and an annular outer portion thereby to form said lower-outer portion of said grinding chamber as a rising passage of a mixture of the grinding media and the material slurry.

11. A media-agitation type pulverizer as defined in claim 10, wherein the ratio S/d is 0.3 or more, if the spacing between said agitating member and said media-separating member is designated by S and if the diameter of said agitating member is designated by d.

12. A media-agitation type pulverizer as defined in claim 10, wherein the total volume of said grinding media is 60 % or less than the volume of said grinding container.

* * * * *